US006264539B1

(12) United States Patent
Chen

(10) Patent No.: US 6,264,539 B1
(45) Date of Patent: Jul. 24, 2001

(54) MECHANISM FOR SLOWING DOWN IDLING SHOE OF AN ELECTRIC POLISHER

(76) Inventor: Tony Chen, No. 228, Sec. 3, Chung-Ching Rd., Taipei (TW)

( * ) Notice: Subject to any disclaimer, the term of this patent is extended or adjusted under 35 U.S.C. 154(b) by 0 days.

(21) Appl. No.: 09/481,384

(22) Filed: Jan. 12, 2000

(51) Int. Cl.[7] ..... B24B 23/00
(52) U.S. Cl. ..... 451/359; 451/357
(58) Field of Search ..... 451/359, 357, 451/353

(56) References Cited

U.S. PATENT DOCUMENTS

| | | | | |
|---|---|---|---|---|
| 4,516,358 | * | 5/1985 | Marton et al. | 451/359 |
| 5,679,066 | * | 10/1997 | Butz et al. | 451/357 |
| 5,813,903 | * | 9/1998 | Amano et al. | 451/357 |
| 5,941,765 | * | 8/1999 | Taylor | 451/359 |
| 6,110,028 | * | 8/2000 | Chung | 451/359 |
| 6,132,300 | * | 10/2000 | Martin | 451/359 |

* cited by examiner

*Primary Examiner*—Eileen P. Morgan
*Assistant Examiner*—Hadi Shakeri
(74) *Attorney, Agent, or Firm*—Dougherty & Troxell

(57) ABSTRACT

A mechanism for slowing down idling shoe of an electric polisher is provided. The mechanism includes an actuating spindle that downward extends through a protective cover connected to a bottom of a housing of the polisher and has a lower end forming an eccentric shaft, a fixing seat that is mounted around the eccentric shaft of the actuating spindle and has a ball bearing fitted therein, a brake ring that has an elastic inner ring tightly fitted around a lower outer periphery of the fixing seat and an outer ring engaged with an underside of the protective cover, a shoe that is screwed to a bottom of the fixing seat for holding a polishing element to a bottom surface of the shoe. When the shoe is idling, the eccentric shaft of the actuating spindle brings the fixing seat to rotate synchronously in eccentric motion to increase a frictional force between the fixing seat and the brake ring, so that the idling shoe is brought to rotate at low speed and vibrate at high frequency.

5 Claims, 4 Drawing Sheets

MECHANISM FOR SLOWING DOWN IDLING SHOE OF AN ELECTRIC POLISHER

FIELD OF THE INVENTION

The present invention relates to a mechanism particularly designed for slowing down an idling shoe of an electric polisher or similar machines that rotate at high speed.

DESCRIPTION OF THE PRIOR ART

In a common polisher, a polishing element, such as a polishing wheel, a grinding wheel or a piece of abrasive non-woven cloth, is fixedly attached to an output shaft of the polisher, and the output shaft of the polisher is directly connected to a driving shaft of a motor. When the motor is started, the polishing element is driven to rotate at high speed to polish an article.

When a conventional electric polisher is turned on, the polishing element attached thereto is immediately driven to rotate at very high speed. A user tends to be dangerously and accidentally injured by the polishing element rotating at high speed.

It is therefore tried by the inventor to develop a mechanism for slowing down an idling shoe of an electric polisher, so that the electric polisher is safe for use.

SUMMARY OF THE INVENTION

A primary object of the present invention is to provide a mechanism for slowing down an idling shoe of an electric polisher so that the shoe of the polisher would not idle at dangerously high speed.

Another object of the present invention is to provide a mechanism for slowing down an idling shoe of an electric polisher so that the polisher is highly safe for use.

To achieve the above and other objects, the mechanism for slowing down idling shoe of an electric polisher according to the present invention mainly includes an actuating spindle that downward extends through a protective cover connected to a bottom of a housing of the polisher and has a lower end forming an eccentric shaft, a fixing seat that is mounted around the eccentric shaft of the actuating spindle and has a ball bearing fitted therein, a brake ring that has an elastic inner ring tightly fitted around a lower outer periphery of the fixing seat and an outer ring engaged with an underside of the protective cover, a shoe that is screwed to a bottom of the fixing seat for holding a polishing element thereto. When the shoe is idling, the eccentric shaft of the actuating spindle brings the fixing seat to rotate synchronously in eccentric motion to increase a frictional force between the fixing seat and the brake ring, so that the idling shoe rotates at low speed and vibrates at high frequency.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
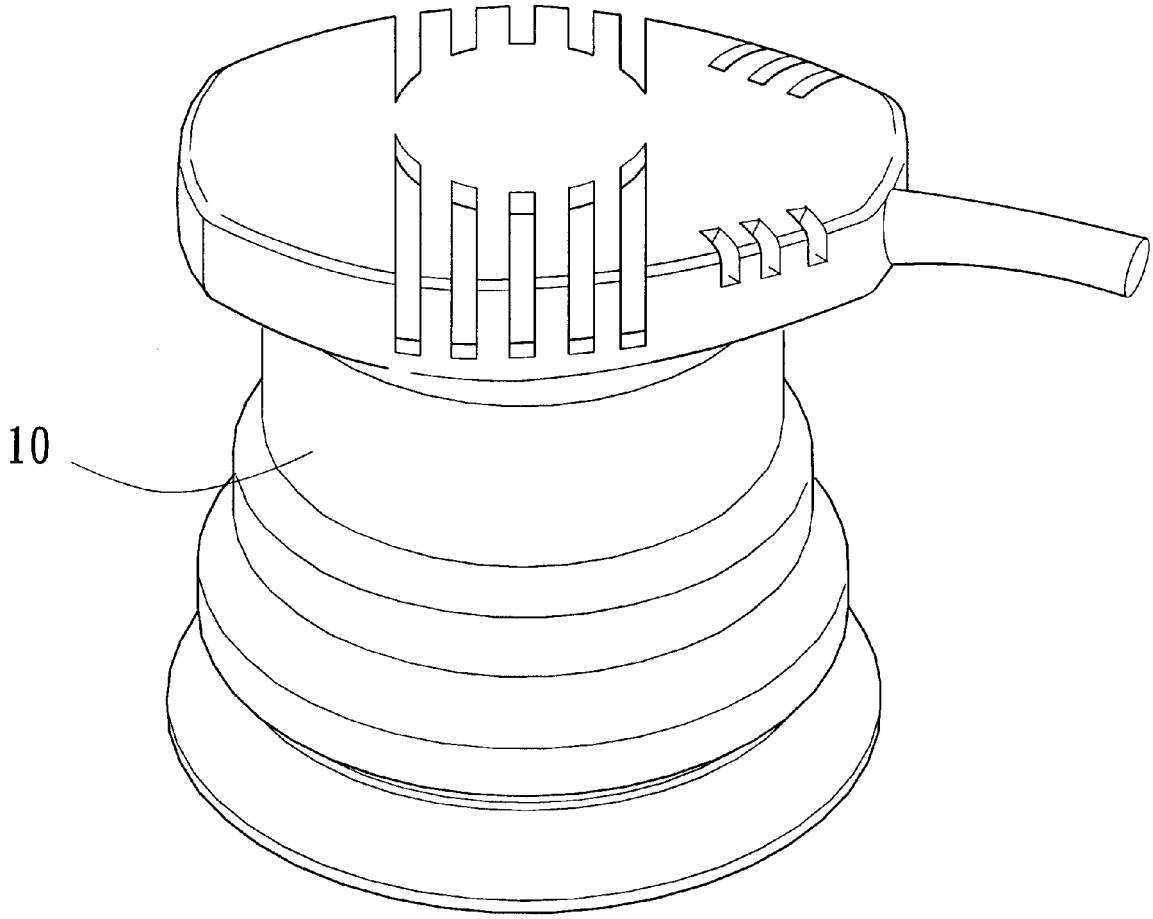
FIG. 1 is a perspective of a polisher to which a mechanism for slowing down an idling shoe of the polisher according to the present invention is mounted.
Figure 2:
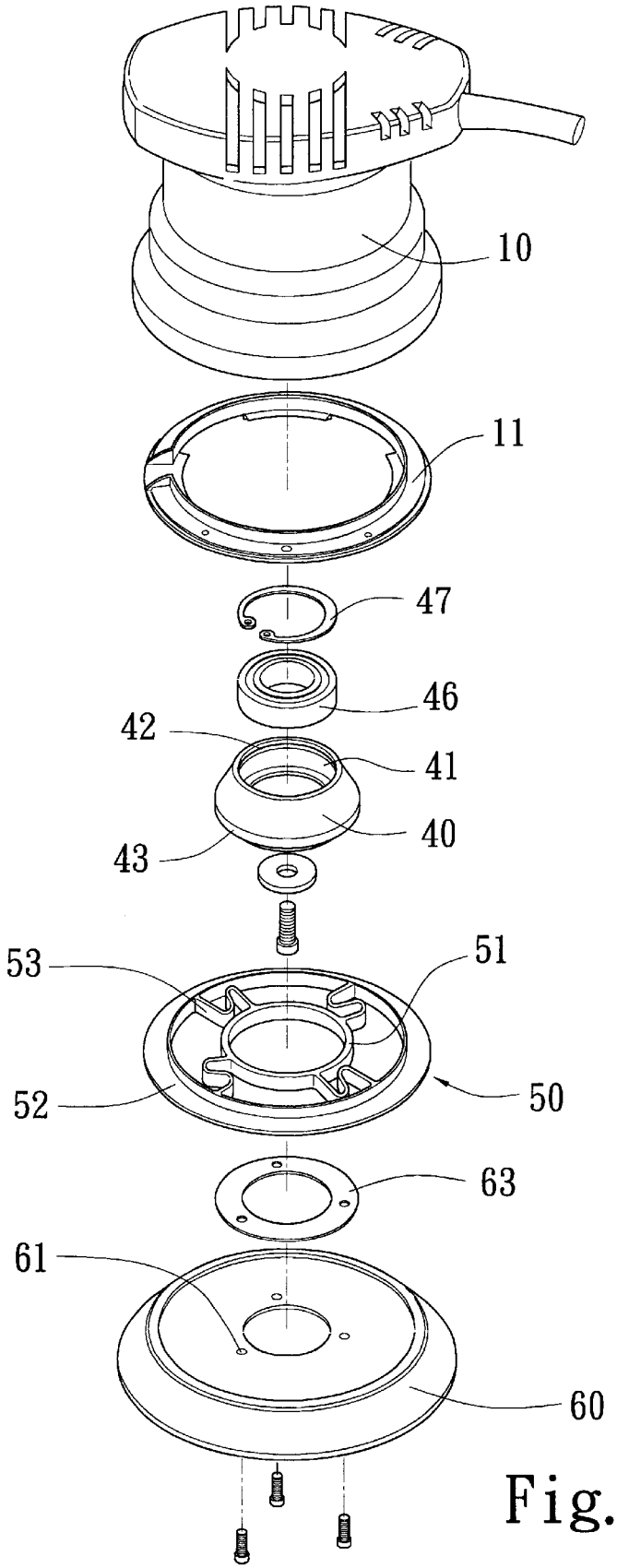
FIG. 2 is an exploded perspective of the polisher of FIG. 1 showing major parts included in the mechanism of the present invention.
Figure 3:
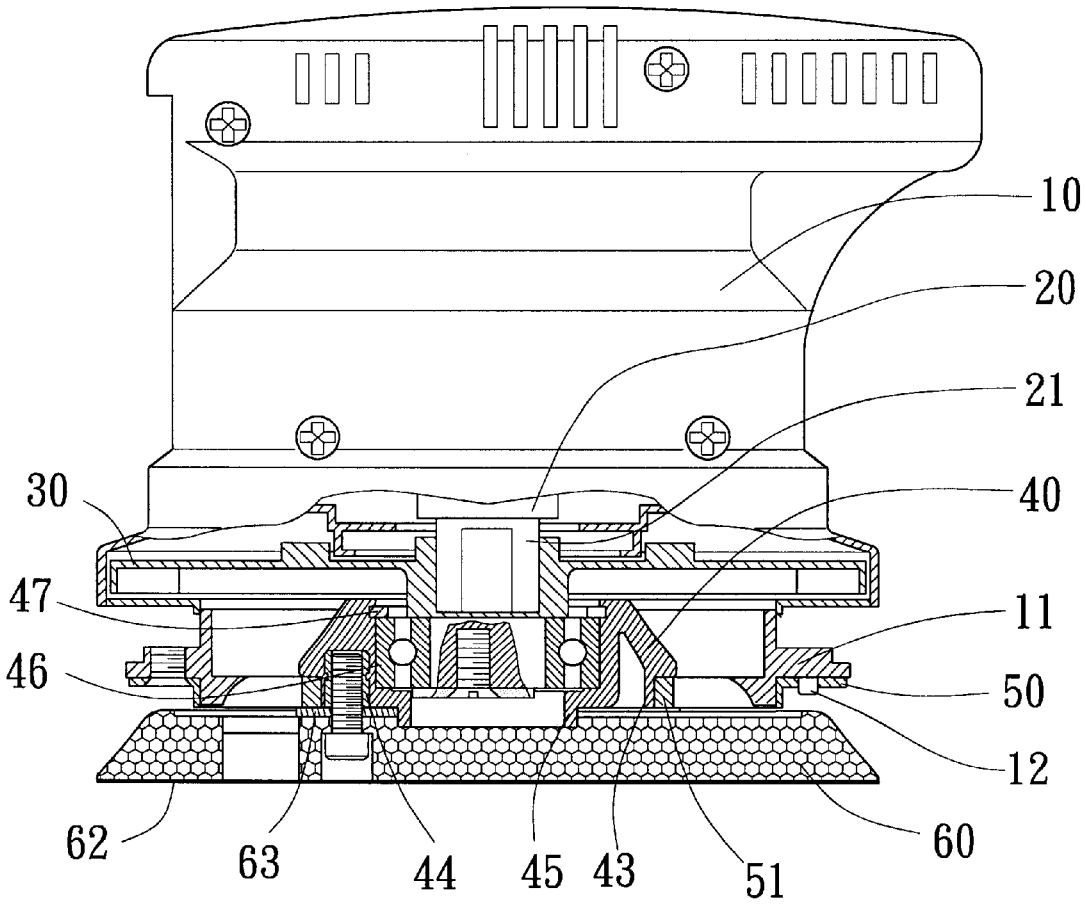
FIG. 3 is a partially sectional view of the polisher of FIG. 1 in an assembled state.

Please refer to FIGS. 1 to 3. The present invention provides a mechanism for slowing down an idling shoe of an electric polisher. The mechanism mainly includes a housing 10 in and below which an actuating means 20, a fan 30, a protective cover 11, a fixing seat 40, a brake ring 50, and a shoe 60 are sequentially mounted from top to bottom.

The actuating means 20 is mounted inside the housing 10 and has an actuating spindle 21 that downward extends through the fan 30, such that the fan 30 is just located in a central opening of the protective cover 11 that is connected to a bottom of the housing 10. The protective cover 11 is provided at an underside of its annular ring portion with a plurality of stub tenons 12. The actuating spindle 21 has a lower end that is in the form of an eccentric shaft.

The fixing seat 40 is in the form of a short truncated cone. A cylindrical inner wall of the fixing seat 40 is provided with an annular recess 41 for receiving a ball bearing 46 therein. An annular groove 42 is further provided along an upper edge of the annular recess 41 for receiving a C-ring 47 therein, so that the C-ring 47 helps to retain the ball bearing 46 in the annular recess 41. A flange 45 vertically downward extends from a lower edge of the annular recess 41. A lower outer periphery of the fixing seat 40 is radially inward reduced to form a stepped surface 43. And, a plurality of threaded holes 44 are provided at underside of the fixing seat 40 between the stepped surface 43 and the flange 45.

The brake ring 50 includes concentric inner ring 51 and outer ring 52 that are connected to each other by several generally S-shaped elastic arms 53 radially extended between the inner and the outer rings 51, 52. The outer ring 52 is provided with a plurality of engaging holes corresponding to the stub tenons 12 on the protective cover 11, so that the brake ring 50 is attached to the underside of the protective cover 11 by engagement of the engaging holes with the stub tenons 12. The inner ring 51 has an inner diameter that permits the inner ring 51 to be fitly put around the stepped surface 43 below the fixing seat 40. That is, when the brake ring 50 is attached to the underside of the protective cover 11, the inner ring 51 is fitted around the stepped surface 43 of the fixing seat 40 in a suitable tightness.

The shoe 60 is provided with several threaded holes 61 around a central hole thereof corresponding to the threaded holes 44 provided at underside of the fixing seat 40. A fastening means 62, such as a hook tape of a Magic Tape (Velcro Tape) is provided at a bottom surface of the shoe 60 for holding a polishing element to the shoe 60.

To assemble the mechanism of the present invention, first extend the eccentric shaft at the lower end of the actuating spindle 21 through the ball bearing 46 fitted in the fixing seat 40, and then fix the brake ring 50 onto the fixing seat 40 by engaging the inner ring 51 with the stepped surface 43 and the engaging holes on the outer ring 52 with the stub tenons 12 on the protective cover 11. Thereafter, put a washer 63 around the flange 45 that downward projects from the bottom of the fixing seat 40. Finally, upward extend screws through the threaded holes 61 on the shoe 60 and into the threaded holes 44 on the fixing seat 40, so that the shoe 60 is screwed below the fixing seat 40 and the brake ring 50. FIG. 1 shows the polisher having the mechanism of the present invention assembled thereto for slowing down the idling shoe 60.

Generally speaking, the shoe 60 rotates at a very high speed that might be more than ten thousands RPM. When the shoe 60 in rotating contacts with an article to be polished, a contact resistance thereof is larger than a centrifugal force of the rotating shoe 60 and therefore the probability for the shoe 60 to cause accident is low. However, when the rotating shoe 60 is removed from the article being polishing, the centrifugal force of the rotating shoe 60 is larger than a frictional resistance thereof and therefore the rotating shoe 60 tends to endanger a user or other people close to the polisher.

Figure 4:
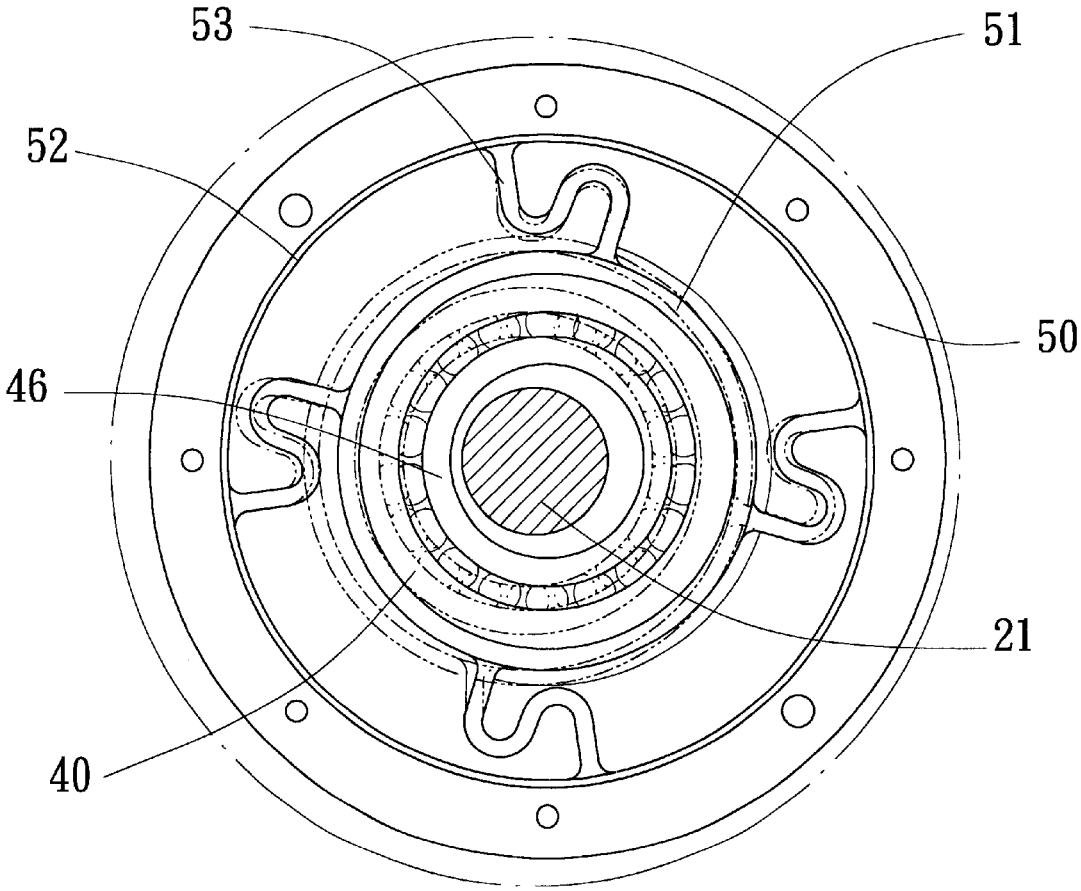
FIG. 4 is a bottom view of the polisher with the shoe thereof in an idling state.

However, when the electric polisher mounted with the mechanism of the present invention is in a no-load state, although the actuating spindle 21 and the fan 30 rotate at high speed, the fixing seat 40 rotates at a slower speed in a planetary motion due to a minor frictional force between it and the ball bearing 46. Moreover, as shown in FIG. 4, when the fixing seat 40 eccentrically rotates along with the eccentric shaft of the actuating spindle 21, the fixing seat 40 touches the brake ring 50 put around the lower outer periphery of the fixing seat 40 and is restricted by the inner ring 51 from moving eccentrically any further. At this point, a frictional force existing between the inner ring 51 and the fixing seat 40 reduces the rotating speed of the shoe 60, causing the shoe 60 to rotate at low speed while vibrating at high frequency.

With the above arrangements, the mechanism for slowing down idling shoe of the electric polisher according to the present invention apparently eliminates the drawbacks existing in the conventional polishers and is therefore safer for use.

What is claimed is:

1. A mechanism for slowing down idling shoe of an electric polisher, comprising a housing that forms a body of the polisher, an actuating spindle that downward extends through a protective cover connected to a bottom of said housing has a lower end forming an eccentric shaft, a fan that is mounted on said actuating spindle, a fixing seat that is mounted around said eccentric shaft of said actuating spindle and has a ball bearing fitted therein, a brake ring that has an elastic inner ring tightly fitted around a lower outer periphery of said fixing seat and an outer ring engaged with an underside of said protective cover, a shoe that is screwed to a bottom of said fixing seat for holding a polishing element to a bottom surface of said shoe, and a washer that is positioned between said fixing seat and said shoe; whereby when said shoe is idling, said eccentric shaft of said actuating spindle brings said fixing seat to rotate synchronously in eccentric motion to increase a frictional force between said fixing seat and said brake ring and thereby slow down said idling shoe.

2. A mechanism for slowing down idling shoe of an electric polisher as claimed in claim 1, wherein said brake ring is made of an elastic material.

3. A mechanism for slowing down idling shoe of an electric polisher as claimed in claim 2, wherein said inner ring and said outer ring of said brake ring are connected to each other by more than one S-shaped elastic arms radially extended between said inner and said outer rings.

4. A mechanism for slowing down idling shoe of an electric polisher as claimed in claim 1, wherein said shoe has fastening means provided at said bottom surface thereof for firmly holding said polishing element to said shoe.

5. A mechanism for slowing down idling shoe of an electric polisher as claimed in claim 1, wherein said fixing seat has a stepped surface provided at said lower outer periphery thereof.

* * * * *